United States Patent [19]

Takizawa et al.

[11] Patent Number: 4,935,327

[45] Date of Patent: Jun. 19, 1990

[54] POLYESTER TONER WITH ANTIOXIDANT FOR DEVELOPMENT OF ELECTROSTATIC LATENT IMAGE

[75] Inventors: Yoshio Takizawa; Jiro Takahashi; Akitoshi Matsubara; Satoru Ikeuchi, all of Tokyo, Japan

[73] Assignee: Konica Corporation, Tokyo, Japan

[21] Appl. No.: 280,865

[22] Filed: Dec. 7, 1988

[30] Foreign Application Priority Data

Dec. 28, 1987 [JP] Japan ..... 333931

[51] Int. Cl.[5] ..... G03G 9/08

[52] U.S. Cl. ..... 430/110; 430/109

[58] Field of Search ..... 430/109, 110

[56] References Cited

U.S. PATENT DOCUMENTS 4,113,493 9/1978 Sandha et al. ..... 430/497 X
4,588,668 5/1986 Yasuda et al. ..... 430/109
4,693,952 9/1987 Koizumi et al. ..... 430/109
4,812,377 3/1989 Wilson et al. ..... 430/110 X

FOREIGN PATENT DOCUMENTS 0084693 8/1983 European Pat. Off. ..... 430/109

*Primary Examiner*—Roland E. Martin
*Attorney, Agent, or Firm*—Finnegan, Henderson, Farabow, Garrett and Dunner

[57] ABSTRACT

A toner for developing an electrostatic image is disclosed, which is not likely cause fogs, toner flying, and solid-black non-uniformity when used for a large number of cpying cycles in a high temperature, high humidity. The toner comprises a polyester resin containing a trivalent or higher monomer as a polymerized component and an antioxidant. As the antioxidant, a compound having a hidered phenolic group is preferably used as the antioxidant.

5 Claims, No Drawings

POLYESTER TONER WITH ANTIOXIDANT FOR DEVELOPMENT OF ELECTROSTATIC LATENT IMAGE

FIELD OF THE INVENTION

This invention relates to toners for use in developing electrostatic latent images formed by electrophotography, electrostatic recording, electrostatic printing, and the like techniques.

BACKGROUND OF THE INVENTION

In known methods of electrostatic photography, for example, those disclosed in U.S. Pat. Nos. 2,297,691 and 2,357,809, an electrostatic latent image is formed on the surface of a photoreceptor and the latent image is then turned into a toner image by a dry developer composed of a fine-powdered coloring material, which toner image, in turn, is transferred onto a transfer sheet, such as paper; and subsequently, the transferred toner image is permanently fixed by application of heat or pressure to produce a photocopy image.

Recently, in the field of copying machines, attention has been directed toward high speed operation and compacturization, and as a fixing technique which can meet such demand, a so-called hot roller fixation system has been preferably employed which provides good thermal officiency, is compact in mechanism and capable of meeting the requirement for operation speed-up.

With the hot roller fixation system, however, the trouble is that since the surface of the toner image goes in contact with the hot roller surface, the toner is transferred onto the hot roller surface and the toner so transferred is in turn transferred onto a sheet subsequently delivered to the roller, the image being thus spoiled, which phenomenon is known as "offset phenomenon".

In an attempt to prevent such offset phenomenon and, more particularly, hot offset phenomenon, it is proposed in Japanese Patent Examined Publication No. 51-23354 to use a crosslinked styrene resin as a binder resin for the toner. However, mere use of such crosslinked styrene resin simply involves a rise in fixing temperatures, so that the image remains partly unfixed under ordinary fixing conditions, there being caused a stain due to low temperature offset at the unfixed portion.

With a view to overcoming the foregoing problems of hot offset and low temperature offset (insufficient fixation), it is proposed in Japanese Patent Examined Publication No. 59-11902 to use a polyester resin having a three-dimensional network as a toner binding resin. However, after having made close examinations with toners using such polyester resin, the present inventors found that while the toners exhibited somewhat satisfactory performance in that they could prevent the occurrence of aforesaid offset phenomenon and provide improved fixation, they could, on the other hand, be a cause of troubles, such as degradation in image characteristics under high-temperature/high-humidity conditions, and deterioration in the durability of the hot roller fixing unit.

For example, when copying is repeated a large number of times in a high temperature/high humidity atmosphere, there will occur increased for, toner fly, and solid-black defect such that a solid-black image is white spotted, with the result that image copies lack consistency. Further, it is likely that toner particles will gradually deposit and accumulate on the surface of heating rollers of the hot roller fixing unit, which will shorten the service life of the fixing rollers, and the toner particles accumulated on the heating rollers will in turn migrate to the back of each transfer sheet, thus causing a back stain.

SUMMARY OF THE INVENTION

This invention is directed to overcoming the foregoing problems, and accordingly it is an object of the invention to provide a toner for development of electrostatic latent images which has good fixing and anti-offset quantities and is suitable for hot roller fixing purposes.

It is another object of the invention to provide a toner for development of electrostatic latent images which, when used for a large number of cycles in a high temperature/high humidity environment, is not likely to cause fogs, toner fly, and solid-black non-uniformity, and which has good serviceability and can afford clear image characteristics.

It is a further object of the invention to provide a toner for development of electrostatic latent images which is not likely to cause hot roller stains or paper back staining and can remarkably enhance the service life of the heating rollers.

The foregoing objects of the invention is accomplished by a toner for developing an electrostatic latent image which composes a polyester resin containing a trivalent or higher monomer as a polymerized component, and an antioxidant.

DETAILED DESCRIPTION OF THE INVENTION

The polyester resin used as a binding resin in the toner of the invention contains a trivalent or higher monomer which gives the resin a three-dimensional molecular structure, and therefore the polyester resin has improved operability in its fused state, and good anti-offset characteristics. Also, in a low temperature condition, the polyester resin can be readily fused and is well fusedly penetrable into a paper sheet at low temperatures, it being thus able to prevent development of a low-temperature offset phenomenon.

However, in such a polyester resin in which a trivalent or higher monomer is used to impart a three-dimentional molecular structure to the resin, there is present a large amount of unreacted —COOH groups from the trivalent or higher monomer which has not been allowed to have a rection opportunity because of steric hindrance.

A toner in which such polyester resin having a large amount of —COOH group or —OH group residues therein is used as a binding resin is subject to progressive increase in the concentration of —COOH or —OH groups in itself or on its surface because of oxidation caused to the toner during the process of it being produced, including the steps of heating/fusing and kneading, and/or because of oxidation of the toner surface under the effect of ozone arising from a charger and/or a transfer unit in the copying machine. Therefore, when copying is carried out for a large number of cycles by using such a toner, there will be gradual increase in the amount of airborne moisture absorbed on the surface of the toner. Where such moisture adsorption is excessive, and more particularly under high temperature/high humidity conditions, electro-static charge on the toner surface is likely to leak and accordingly there will be increased fogs due to the toner becoming less electrified, toner flying and extended charge distribution or increased proportion of low-charged toner particles, due to the electrostatic adhesivity being lowerd of toner and carrier particles, and decreased fluidity of toner particles due to their moisture adsorption; and thus the development performance of the developer will be adversely affected with the result of an undeveloped white area being produced on an image which should otherwise be solid black, the uniformity of a solid-black image being thus degraded.

Because of these factors, the durability of the developer is finally lost.

Further, in the stage of hot roller fixation, an increase in the number of —COOH and/or —OH groups results in increased adhesiveness of toner particles relative to the surface of the heating rollers, so that a porportion of the toner particles tends to deposit and accumulate on the hot roller surface. As such tendency becomes excessive with an increase in the number of copying cycles, the toner accumulated on the upper roller of the heating rollers tends to migrate to the lower roller to stain it, and thus in the stage of fixation the toner deposited and accumulated on the lower roller tends to migrate to the surface of a transfer sheet, inviting back contamination.

Therefore, studies were made with a view to preventing the progress of oxidation, a factor which was considered to be a main cause of aforesaid problem, and as a result it was discovered that the problem could be solved by using an antioxidant in combination with the foregoing polyester as a binding resin.

The antioxidant used in the present invention serves to prevent the progress of oxidation of the polyester resin which is otherwise likely to be comparatively easily oxidized in the stage of kneading in the production process for the toner, and at same time it serves to prevent the progress of oxidation of the toner surface due to ozone produced in the copying machine. More specifically, a phenolic antioxidant is preferably used as such, and inter alia one having a hindered phenolic group is more preferably used.

When such toner is used, progress of oxidation can be prevented, and accordingly excessive moisture adsorption on the toner surface can be prevented; also drops in the amount of toner charge and in toner surface resistance can be prevented. Thus, possible increased fogs and toner fly due to prolonged use of the toner can be well prevented. Further, the range of charge distribution can be narrowed and the fluidity of the toner is unlikely to be lowered. Therefore, the toner permits stable and satisfactory development and renders it possible to provide a uniform solid-black image, which in turn leads to improved toner serviceability.

Again, the toner has the effectiveness of preventing any possible increase in the number of —COOH or —OH groups on the toner surface. Accordingly, the possibility of toner particles tending to increasingly adhere to the heating rollers is eliminated; the deposition and accumulation of toner particles on the heating rollers can be prevented; lower-roller staining can be avoided; and back contamination is prevented.

In addition to the foregoing effects, the toner of the invention can provide more stable triboelectric effect than the prior art toners if an antioxidant having good triboelectric effect is selected for use therein.

Hindered phenols useful in the practice of the invention are exemplified below but without limitation thereto. Their respective melting points (mp) or solidifying points (sp) are shown in ° C in parentheses. It is noted that values for melting points are shown without abbreviation mp.

Examples of Hindered Phenols:

| | | |
|---|---|---|
| 1. | Mono-t-butyl-p-cresol | (>49, sp) |
| 2. | Mono-t-butyl-m-cresol | (21, sp) |
| 3. | Bytylhydroxyanisole | (57–67) |
| 4. | 2,6-di-t-butyl-p-cresol | (69.9) |
| 5. | 2,6-di-t-bytylphenol | (37) |
| 6. | 2,6-di-t-bytyl-4-ethylphenol | (>43) |
| 7. | 2,6-tri-t-butylphenol | (131) |
| 8. | 4-hydroxymethyl-2,6-di-t-bytyl | (140–141) |
| 9. | Octadecyl-3-(4-hydroxy-3',5'-di-t-butylphenyl)propionate | (49–52) |
| 10. | Distearyl(4-hydroxy-3-methyl-5-butyl) benzyl malonate | (56–59.5) |
| 11. | 6-(4-hydroxy-3,5-di-t-butyl anilino)2,4-bisoctylthio-1,3,5-triazine | (91–96) |
| 12. | 2,6-diphenyl-4-octadecanoxy phenol | (62–63) |
| 13. | 4-t-butylcatechol | (750) |
| 14. | 2,5-t-butylhydroquinone | (202) |
| 15. | 2,5-di-t-amylhydroquinone | (>172) |
| 16. | Propyl gallate | (146–148) |
| 17. | 4,4'-methylene bis(2,6-t-butylphenol) | (>154) |
| 18. | 4,4'-isopropylidene bis(2,6-di-t-butylphenol) | (155–156) |
| 19. | 4,4'-butylidene bis(3-methyl-6-t-butylphenol) | (208–212) |
| 20. | 2,2'-methylene bis(4-methyl-6-t-butylphenol) | (130–133) |
| 21. | 2,2'-methylene bit(4-ethyl-6-t-butylphenol | (>119) |
| 22. | 2,2-isobutylidene bis(4,6-dimethylphenol) | (−160) |
| 23. | 2,2'-dihydroxy-3,3'-di-(α-methylcyclohexyl)-5,5'-di-methyl diphenylmethane | (−130) |
| 24. | 2,2-methylene bis(4-methyl-6-cyclohexyl phenol) | (≧180) |
| 25. | 2,6-bis-(2'-hydroxy-3'-t-butyl-5'-methylbenzyl)4-methylphenol | (171–172) |
| 26. | N,N'-hexamethylene bis(3,5-di-t-butyl-4-hydroxyhydrocinnamate) | (156–161) |
| 27. | Hexamethylene glycol bis[β-(3,5-di-t-butyl-4-hydroxyphenyl) propionate] | (49–54) |
| 28. | Triethylene glycol bis[β-(3-t-butyl-5-methyl-4-hydroxyphenyl)priopionate] | (76–79) |
| 29. | Tris[β-(3,5-di-t-butyl-4-hydroxyphenyl) propionyloxyethyl oxyethyl] isocyanurate | (126–131) |
| 30. | 1,3,5-tris(2,6-dimethyl-3-hydroxy-4-t-butylbenzyl)isocyanurate | (143) |
| 31. | Tris(3,5-di-t-butyl-4-hydroxyphenol) isocyanurate | (221) |
| 32. | 1,1,3'-tris(2-methyl-4-hydroxy-5-t-butylphenyl)butane | (185–188) |
| 33. | Tetrakis [methylene-3-(3,5-di-t-butyl-4-hydroxyphenyl)propionate]methane | (110–125) |

In order to allow the toner to maintain good blocking resistance and good fluidity in particular, the melting point of the hindered phenol should be preferably not lower than 20° C., and in order to allow the toner to exhibit good fixing performance, the melting point should preferably be not higher than 230° C.

The proportion of the hindered phenol relative to the toner is preferably 0.01–10% by weight, more preferably 0.1–5% by weight. If the proportion is less than 0.01% by weight, no sufficient antioxidant effect can be obtained, and if it exceeds 10% by weight, the toner exhibits no satisfactory offset performance, with the result that the fixing rollers may be stained, their durability being thus degraded.

The binding resin used in the present invention should preferably be a polyester resin produced by polycondensation of a dihydric or higher polyvalent alcohol monomer and a bivalent or higher polyvalent carboxylic acid monomer. For offset preventing purposes, it is preferable that the polyester resin should be a non-linear polyester resin in which trivalent or higher polyvalent monomers are used to give non-linear molecular orientation.

For useful diols, the following may be mentioned by way of example: such diols as ethylene glycol, diethylene glycol, trienthylene glycol, 1,2-propylene glycol, 1,3-propylene glycol, 1,4-butanedid, neopentyl glycol, and 1,4-butenediol; bisphenols such as 1,4-bis(hydroxymethyl) cyclohexane, bisphenol A, and hydrogenated bisphenol A; etherified bisphenols such as polyoxypropylene (2,2)-2,2-(4-hydroxyphenyl)propane, polyoxypropylene (3,3)-2,2-bis(4-hydroxyphenyl)propane, polyoxyethylene(2,0)-2,2-bis(4-hydroxyphenyl)propane, polyoxypropylene(2,0)-polyoxyethylene(2,0)-2,2-bis(4-hydroxyph enyl)propane, and polyoxypropylene(6,0)-2,2-bis(4-hydroxyphenyl)propane; and other dihyrdric alcohol monomers.

For useful dicarboxylic acids, maleic acid, fumaric acid, succinic acid, adipic acid, sebacic acid, malonic acid, itaconic acid, citraconic acid, mesaconic acid, glutaconic acid, cyclohexanedicarboxylic acid, phthalic acid, isophthalic acid, terephthalic acid, and their anhydrides or ester derivatives.

For the purpose of non-linear orientation, trivalent or higher polyvalent monomer components may be used in addition to aforementioned bivalent monomer components. As examples of such polyvalent monomers, that is, trivalent or higher polyvalent polyol monomers, the following may be mentioned: sorbitol, 1,2,3,6-hexanetetrol, 1,4-sorbitane, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, etc.

As examples of trivalent or higher polyvalent carboxylic acid monomers there may be mentioned 1,2,4-benzene tricarboxylic acid, 1,2,5-benzene tricarboxylic acid, 1,2,4-cyclohexane tricarboxylic acid, 2,5,7-naphthalene tricarboxylic acid, 1,2,4-nephthalene tricarboxylic acid, 1,2,4-butane carboxylic acid, 1,2,5-hexane tricarboxylic acid, 1,3-dicarboxyl-2-methyl-2-methylene carboxyl propane, tetra (methylene carboxyl) methane, pyromellitic acid, 1,2,7,8-octane tetracarboxylic acid, cyclohexane tetracarboxylic acid, 1,2,5,6-hexane tetracarboxylic acid, empole trimer acid, and their anhydrides or lower alkyl esters.

Any such trivalent or higher polyvalent monomer component should proferably be contained in a proportion of 0.1 to 80 mol%, more preferably 5 to 50 mol%, in each alcohol or acid component as a structural unit of a polymer. If its proportion is unreasonably small, no good durability is obtainable, while if the proportion is excessively large, no satisfactory fixing performance is attainable.

Of the foregoing monomer components, benzene-tricarboxylic acid is most preferred for use since it provides good advantage in respect of fixing characteristics, offset preventive properties, and triboelectric effect. Also, it is preferable to use etherified phenols as diol components, since they can produce advantageous effects in furthering offset preventive performance of the toner and durability of triboelectric developers.

The softening point of the polyester resin in the present invention is preferably within the range of 100° C. to 150° C. If it is lower than 100° C., no good anti-offset effect is obtainable, and if it is higher than 150° C., no favorable fixing performance is achievable.

The glass transition temperature of the polyester resin in the invention is preferably within the range of 55° C. to 70° C. If it is lower than 55° C., no satisfactory blocking resistance is obtainable, and if it exceeds 70° C., no favorable fixing performance is achievable.

Preferably, the polyester resin in the present invention should have a acid value of not more than 50. If the acid value is higher than 50, there may be increased trouble of toner fly and fixing roller contamination.

Polyester resins for use in the present invention can be produced by subjecting a carboxylic acid component and a polyol component to polycondensation reaction in an inert gas atmosphere in a temperature range of 100 to 250° C. For the purpose of reaction acceleration, catalysts, such as dibutyl tin oxide, zinc oxide, titanium oxide, and tin oxide, may be used.

The toner of the invention may contain other resins, such as linear polyester, polyamide, polyerethane, epoxy resin, and styrene-acrylic copolymers, but the proportion of such resins should proferably be limited to not more than 30% by weight.

In the present invention, particles of the toner may include such toner components dispersed therein as, for example, colorant, charge control agent, fixing characteristic improving agent, magnetic particles, and other characteristic improving agents.

For use as a colorant in the toner of the invention, known colorants may be used, including, for example, carbon black, benzine yellow, quinacridone, rhodamine B, and phthalocyanine blue.

For use as magnetic particles in the toner of the invention, particles of those materials which are subject to magnetization in a magnetic field, including, for example, powder of ferromagnetic metals, such as iron, cobalt, and nickel, and compounds, such as magnetite, maghmatite, and ferrite. When an iron oxide magnetic substance is used as a colorant, its proportion in the toner may be within a range of 10 to 80% by weight.

Among charge control agents suitable for use in the toner of the invention are metal complex dyes and nigrosine dyes.

For the purpose of the fixing performance improving agent to be contained in the toner of the invention, it is possible to use, for example, polyolefin, fatty acid metallic salt, fatty acid ester and fatty acid ester wax, partially saponified fatty acid ester, higher fatty acid, higher alcohol, fluid or solid paraffine wax, amide wax, polyol ester, silicon varnish, and fatty fluorocarbon. By using such fixing performance improving agent is it possible to attain improved releasability, thus to prevent paper jamming or the like trouble at the hot roller fixing unit.

One preferred method for production of the toner of the invention is given below by way of example. A binding resin or such material which is loaded with toner components, such as colorant and the like, as required is melted and kneaded, for example, by an extruder, and after being cooled, the mixture is pulverized in a jet mill or the like; then the pulverized particles are classified to give a toner of a desired particle size.

Further, in using the toner of the invention, it is preferable that the toner particles obtained in manner as above described, after being surface-treated, are admixed with carrier particles, whereby stable triboelectric effect can be obtained. Especially where particles surface treated with resin are used as carrier particles, favorable effects can be obtained for improvement of developer durability and stabilization of the triboelectric effect of the toner against environmental changes.

It is preferable that the toner of the invention is used in mixture with such fine inorganic particles as will enhance toner fluidity and contribute toward improved development and transfer performance.

Primary particle diameter of such fine inorganic particles is preferably within the range of 5 mμ to 2 μm, more preferably 5 mμ to 500 mμ.

Specific surface area of the fine inorganic particles as measured by BET is preferably within the range of 20 to 500 $m^2$/ g. The proportion of the fine inorganic particles is preferably 0.01 to 5% by weight, preferably 0.01 to 2.0% by weight relative to the toner. Illustrative of such fine inorganic particles are particles of materials such as, for example, silica, alumina, titanium oxide, barium titanate, magnesium titanate, calcium titanate, strontium titanate, zinc oxide, silica sand, clay, mica, wollastonite, diatom earth, chrome oxide, cerium oxide, iron oxide red, antimony trioxide, magnesium oxide, zirconium oxide, barium sulfate, barium carbonate, calcium carbonate, silicon carbide, and silicon nitride. More especially, fine silica particles are preferred. Varieties of fine silica particles are commercially available, of witch those having hydrophobic groups on particle surface are especially preferred; among those preferred varieties are "Aerosil R-972", "Aerosil R-974", "Aerosil R-805", "Aerosil R-81238 (all of production by Aerosil), and "Tullanox 500" (a product of Tulco), for example.

In order to perform fixation by using the toner of the invention, a hot roller fixing system is preferably employed, in which the fixing rollers are preferably such that the upper roller is fluoroplastic-coated and the lower roller is a comparatively flexible one made of silicone rubber or fluoroplastic-coated silicone rubber, because such construction provides good offset resistance, serves to prevent paper jamming, and assures improved roller durability.

SYNTHESIS EXAMPLE AND EXAMPLES

Nextly, synthesis example for synthesis of resins representative of those useful for the purpose of the invention, and examples with respect to the present invention will be explained; it is to be understood, however, that the invention is not limited to these examples.

Synthesis Examples

| (1) Binder A | |
|---|---|
| Polyoxypropylene(2,2)-2,2-bis(4'-hydroxyphenyl) propane | 443 g |
| Polyoxyethylene(2)-2,2-bis(4'-hydroxypheny) propane | 176 g |
| Terephthalic acid | 120 g |
| Di-isopropyl orthotitanate (esterification catalyst) | 0.8 g |

The materials were placed in a 1l capacity round bottomed flask equipped with a thermometer, a stainless steel made agitator, a glass made nitrogen gas introducing pipe, and a downflow type condenser, and the flask was set on a mantle heater. Nitrogen gas was introduced into the flask through the nitrogen gas introducing pipe, and the temperature in the flask was raised to 230° C. while interior of the flask was kept in an inert atmosphere. Reaction was carried out under agitation. At a point when there was no longer distillation of water produced as a result of the reaction, acid value of the flask content measured at 1.5.

Further, 139 g of 1,2,4-benzene tricarboxylic acid anhydride was added and reaction was allowed to take place over a period of about 8 hours. Reaction was terminated when an acid value of 17 was reached.

The resin thus obtained was in the form of a light yellow solid. The resin was measured for its softening point by a Flow Tester CFT-500 (made by Shimadzu Seisakusho Ltd.), which measurement showed a softening point of 125° C.

| (2) Binder B | |
|---|---|
| Polyoxypropylene(2,2)-2,2-bis(4'-hydroxyphenyl) propane | 482 g |
| Polyoxyethylene(2)-2,2-bis(4'-hydroxypheny) propane | 126 g |
| 1.6-hexanediol | 24 g |
| Fumaric acid | 174 g |
| Di-isopropyl orthotitanate (esterification catalyst) | 0.8 g |

The above materials were caused to react in same manner as in the production of the binder A, and further 77 g of 1,2,4-benzene tricarboxylic acid anhydride was added for reaction over a period of about 8 hours. When an acid value of 22 was reached, the reaction was terminated.

The resin thus obtained was in the form of a light yellow solid. This resin was measured for its softening point by the Flow Test CFT-500, which measurement indicated a softening point of 125° C.

| (3) Binder C | |
|---|---|
| Polyoxypropylene(2,2)-2,2-bis(4'-hydroxyphenyl) propane | 482 g |
| Polyoxyethylene(2)-2,2-bis(4'-hydroxypheny) propane | 190 g |
| Terephthalic acid | 210 g |
| Dodecenyl succinic acid anhydride | 48 g |
| Adipic acid | 31 g |
| Di-isopropyl orthotitanate (esterification catalyst) | 0.8 g |

The above materials were caused to react in same manner as in the production of the binder A, and further 35 g of 1,2,4-benzene tricarboxylic acid anhydride was added for reaction over a period of about 8 hours. When an acid value of 12 was reached, the reaction was terminated.

The resin thus obtained was in the form of a light yellow solid. This resin was measured for its softening point by the Flow Test CFT-500, which measurement indicated a softening point of 126° C.

| (4) Binder D | |
|---|---|
| Triethyleneglycol | 300 g |
| Isophthalic acid | 182 g |

The above materials were caused to react in same manner as in the production of the binder A, and further 138 g of 1,2,4-benzene tricarboxylic acid anhydride was added for reaction over a period of about 8 hours. When an acid value of 12 was reached, the reaction was terminated.

The resin thus obtained was in the form of a light yellow solid. This resin was measured for its softening point by the Flow Test CFT-500, which measurement indicated a softening point of 128° C.

EXAMPLES 1 — AND COMPARATIVE EXAMPLE (1)

Production of Toner

According to the combination shown in Table 1 below. 100 parts by weight of binder from one of the foregoing synthesis examples, 10 parts by weight of carbon black "Morgal L " (made by Cabot), 3 parts by weight of polypropylene ("Biscole 660P ", made by Sanyo Chemical Industries, Ltd.), and 1 part by weight of a hidered phenol according to the invention were mixed, and the mixture was throughly melted and kneaded by a twin roll at 100–130° C.; then the hot mixture was cooled, and roughly crushed by a hammer mill, then finely crushed by a ject mill. The resulting particles were classified, and thus a sample toner having a particle size range of 3 to 30 μm and mean particle diameter of 10.0 μm was obtained. It is noted that each comparative example toner has not hindered phenol added therein.

Preparation of Developer

A developer was prepared by mixing 4 parts by weight of one of the sample toners and 96 parts by weight of carrier, spherical ferrite particles "F-150", made by Nihon Teppunsha Co.

Developers obtained in Examples 1–6 were designated as "Developer 1" - "Developer 6" respectively, and developers obtained in comparative examples (1) and (2) were designated as "Comparative Developer (1)" and "Comparative Developer (2)" respectively.

TABLE 1

| | Binder | Hindered Phenol |
|---|---|---|
| Example 1 | A | Exemplified as 4*[1] |
| Example 2 | B | Exemplified as 4 |
| Example 3 | C | Exemplified as 4 |
| Example 4 | D | Exemplified as 4 |
| Example 5 | A | Exemplified as 9*[2] |
| Example 6 | A | Exemplified as 33*[3] |
| Comp Examp (1) | A | None |
| Comp Examp (2) | B | None |

*[1]Sumiliser BHT (made by Sumitomo Chemical Co., Ltd.)
*[2]MARK A0 - 50 (made by Adeca Argus)
*[3]MARK A0 - 60 (made by Adeca Argus)

Copying Tests

Under environmental conditions of 30° C. and 80%RH, photography tests were conducted with the foregoing developers by employing an electrophotographic copying machine "U-Bix-50000" (made by Konica Corp.) comprising a selenium photoreceptor, a hot roller fixing unit consisting of a fixing upper roller having a surface layer formed of Teflon (polytetrafluoroethylene, made by Dupont Co., Ltd.) and a back-up lower roller having a surface layer formed of silicone rubber "KE-1300RTV" (made by the Shin-Etsu Chemical Co., Ltd.), and a cleaning unit, at a temperature of 33° C. and a relative humidity of 80%, in each of which tests copy images were continuously formed for 100,000 cycles. Evaluation was made on the following items. Results are shown in Table 2.

TABLE 2

| | Fog (%) | | | | | | | |
|---|---|---|---|---|---|---|---|---|
| | Initial copy | 60,000th copy | 80,000th copy | 10,000th copy | Solid-black uniformity* | Toner flying | Back contamination | Fix roller contamination* |
| Developer-1 | 0.0 | 0.0 | 0.0 | 0.0 | Good | None | None | Good |
| Developer-2 | 0.0 | 0.1 | 0.1 | 0.2 | Good | None | None | Good |
| Developer-3 | 0.0 | 0.0 | 0.0 | 0.1 | Good | None | None | Good |
| Developer-4 | 0.0 | 0.1 | 0.2 | 0.2 | Good | None | None | Good |
| Developer-5 | 0.0 | 0.1 | 0.1 | 0.2 | Good | None | None | Good |
| Developer-6 | 0.0 | 0.1 | 0.1 | 0.1 | Good | None | None | Good |
| Comp, Developer (1) | 0.0 | 0.2 | 0.7 | 1.2 | Not Good | Observed with 85,000th and subsequ copies | Observed with 80,000th and subsequ copies | Not Good |
| Comp, Developer(2) | 0.0 | 0.4 | 1.2 | 1.3 | Not Good | Observed with 70,000th and subsequ copies | Observed with 70,000th and subsequ copies | Not Good |

*After completion of 100,000 sheet copying

EVALUATION (1) Fog

Evaluation was made by measuring relative density of original white portion with a density of 0.0 to a corresponding copy portion by employing a "Sakura Densitometer" (made by Konica K.K.). Reflection density of the white portion was taken as 0.0.

(2) Solid black uniformity

Evaluation was made by measuring the area ratio of a white spot caused to a copy image portion corresponding to a black portion of the original by employing a dot analyser "Sakura Area Duck-100" (made by Konica K.K.). A white spot area ratio of less than 5% was rated "Good; if the ratio is 5% to less than 10%, it is rated "Poor"; and if the ratio is more than 10%, it is rated "Not Good".

(3) Toner Flying

The interior of the copying machine and copy images were visually examined, and where toner flying was found noticeable and considered to be a problem from a practical point of view, it was determined that toner flying did "occur".

(4) Back

Back side of each sheet of copy paper was visually examined, and with those found as "noticeably contaminated it was determined that back contamination did "occur".

(5) Fix roller contamination

Evaluation was made by visually examining heating rollers constituting the fixing unit. Where heat roller stains were found noticeable and considered to be a problem from a practical point of view, the case was rated "Not Good"; where some contamination was found with the hot rollers but it was considered to be of a level tolerable as practical, the case was rated "Poor"; and where no or little contamination was found, the case was rated "Good".

The melting point referred to herein is measured by a conventional melting point measuring apparatus.

The softening point (Tsp) referred to herein is a temperature measured in such a way that by employing a flow tester CFT-500 made by Shimadzu Seisakusho, Ltd. with measurement conditions of 30 kg/cm$^2$ of load, nozzle diameter of 1 mm, nozzle length of 1 mm, 10 min preheating at 40° C., and heat-up rate of 6° C./min, a 1 cm$^3$ sample weight (a, weight expressed by real specific gravity x 1 cm$^3$) is measured and recorded to give a flow-tester plunger downward movement - temperature curve or softening flow curve, the temperature being shown as a temperature for h/2 where h is the height of an S curve in the flow curve.

In the present invention, the term glass transition temperature is a temperature measured by employing a differential scanning calorimeter "Low Temperature DSC" made by Rigaku Debkisha Co., Ltd. and at a heat-up rate of 10° C., the temperature representing a temperature at an intersecting point between an extension line of a base line below a glass transition point and a tangent line which represents a maximum inclination between a threshold portion and a top point of peak.

The term "acid value" in the invention means a value expressed in terms of milligrams of the quantity of potassium hydroxide necessary for neutralizing an acid contained in 1 g of a sample.

What is claimed is:

1. A toner for developing an electrostatic latent image, which comprises a polyester resin comprising a trivalent or higher monomer as a polymerized component and an antioxidant having a hindered phenolic group, wherein said antioxidant is contained in said toner in an amount of from 0.01% to 5% by weight.

2. The toner of claim 1, wherein said monomer is a polycarboxylic acid having at least three carboxyl groups.

3. The toner of claim 2, wherein said polycarboxylic acid is a benzenetricarboxylic acid.

4. The toner of claim 3, wherein said monomer is contained in said resin in a ratio of from 0.1 mol% to 80 mol% of the total amount of acidic monomer components in said resin.

5. The toner of claim 4, wherein said monomer is contained in said resin in a ratio of from 5 mol% to 50 mol% of the total amount of acidic monomer components in said resin.

* * * * *